US009145890B2

(12) United States Patent
Park et al.

(10) Patent No.: US 9,145,890 B2
(45) Date of Patent: Sep. 29, 2015

(54) ROTARY COMPRESSOR WITH DUAL ECCENTRIC PORTION

(71) Applicants: Joonhong Park, Seoul (KR); Byeongchul Lee, Seoul (KR); Yunhi Lee, Seoul (KR)

(72) Inventors: Joonhong Park, Seoul (KR); Byeongchul Lee, Seoul (KR); Yunhi Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 305 days.

(21) Appl. No.: 13/733,804

(22) Filed: Jan. 3, 2013

(65) Prior Publication Data

US 2013/0171017 A1 Jul. 4, 2013

(30) Foreign Application Priority Data

Jan. 4, 2012 (KR) ..... 10-2012-0001114

(51) Int. Cl.

| | |
|---|---|
| ***F04C 2/00*** | (2006.01) |
| ***F04C 11/00*** | (2006.01) |
| ***F04C 23/00*** | (2006.01) |
| ***F01C 1/063*** | (2006.01) |
| ***F16N 13/20*** | (2006.01) |
| ***F04B 39/00*** | (2006.01) |
| ***F04B 53/00*** | (2006.01) |

(Continued)

(52) U.S. Cl.

CPC ..... *F04C 18/0207* (2013.01); *F04C 18/3564* (2013.01); *F04C 23/008* (2013.01); *F04C 27/005* (2013.01); *F04C 2240/60* (2013.01); *F04C 2270/12* (2013.01)

(58) Field of Classification Search

CPC .. F04C 18/3364; F04C 18/356; F04C 23/008; F04C 27/005

USPC ..... 418/243, 209, 211, 215, 212, 63; 417/313

See application file for complete search history.

(56) References Cited

U.S. PATENT DOCUMENTS 3,137,235 A * 6/1964 Brown ..... 417/220
4,971,535 A * 11/1990 Okada et al. ..... 418/133

(Continued)

FOREIGN PATENT DOCUMENTS

CN 1241685 A 1/2000
CN 1430705 A 7/2003

(Continued)

OTHER PUBLICATIONS

Chinese Office Action issued in Application No. 201310001077.6 dated Feb. 11, 2015.

(Continued)

*Primary Examiner* — Thai Ba Trieu
*Assistant Examiner* — Deming Wan
(74) *Attorney, Agent, or Firm* — Ked & Associates, LLP

(57) ABSTRACT

A rotary compressor including two eccentric portions is provided. The rotary compressor includes: a casing; a cylinder provided within the casing and providing a compression space; a rotational shaft rotatably disposed with respect to the cylinder; a partition plate rotating together with the rotational shaft and dividing the compression space of the cylinder into first and second compression chambers disposed up and down; first and second eccentric portions provided in upper and lower portions of the partition plate and being eccentric in different directions with respect to a rotation center of the rotational shaft so as to rotate together with the rotational shaft; and a driving motor rotatably driving the rotational shaft.

19 Claims, 5 Drawing Sheets

(51) Int. Cl.

| | |
|---|---|
| ***F04C 18/02*** | (2006.01) |
| ***F04C 27/00*** | (2006.01) |
| ***F04C 18/356*** | (2006.01) |

(56) References Cited

U.S. PATENT DOCUMENTS

| | | | | |
|---|---|---|---|---|
| 5,322,424 | A * | 6/1994 | Fujio | 418/11 |
| 7,290,994 | B2 * | 11/2007 | Kitaichi et al. | 418/60 |
| 7,878,778 | B2 * | 2/2011 | Shimizu et al. | 418/59 |
| 8,033,135 | B2 * | 10/2011 | Okaichi et al. | 417/313 |
| 2006/0093494 | A1 | 5/2006 | Kitaichi et al. | |
| 2007/0261238 | A1 * | 11/2007 | Sato et al. | 29/888.02 |
| 2011/0150683 | A1 * | 6/2011 | Lee et al. | 418/5 |

FOREIGN PATENT DOCUMENTS

| | | | |
|---|---|---|---|
| CN | 101070849 | A | 11/2007 |
| CN | 101749238 | A | 6/2010 |
| EP | 1 655 492 | A1 | 5/2006 |
| WO | WO 02/04787 | A2 | 1/2002 |

OTHER PUBLICATIONS

European Search Report issued in Application No. 13150108.2 dated Mar. 25, 2015.

* cited by examiner

ROTARY COMPRESSOR WITH DUAL ECCENTRIC PORTION

The present disclosure relates to subject matter contained in priority Korean Application No. 10-2012-0001114, filed on Jan. 4, 2012, which is herein expressly incorporated by reference in its entirety.

1. FIELD OF THE INVENTION

The present invention relates to a rotary compressor having two eccentric portions and, more particularly, to a rotary compressor in which a piston is eccentrically rotated in a cylinder to compress a fluid.

2. DESCRIPTION OF THE RELATED ART

In general, a compressor includes a driving motor generating driving force in an internal space of an airtight container and a compression mechanism unit coupled to the driving motor and operating to compress a refrigerant. The compressor may be classified into a reciprocating compressor, a scroll compressor, a rotary compressor, an oscillating compressor, and the like. The reciprocating compressor, the scroll compressor, and the rotary compressor use rotary power of a driving motor and the oscillating compressor uses a reciprocating motion of a driving motor.

Among the foregoing compressors, a driving motor of the rotary compressor includes a stator fixed to the airtight container, a rotor inserted into the stator with a predetermined air gap therebetween and rotating according to interaction with the stator, and a rotational shaft coupled to the rotor and transferring rotary power of the rotor to the compression mechanism unit. The compression mechanism unit rotates within a cylinder to suck, compress, and charge a refrigerant, and includes a plurality of bearing members supporting the compression mechanism unit and forming a compression chamber together with the cylinder.

The compression mechanism unit includes an eccentric portion formed on the rotational shaft and a rolling piston inserted into an outer circumferential portion of the eccentric portion. The compression chamber is formed by the rolling piston and the cylinder. The compression chamber is divided into a suction space and a discharge space by a vane, and a refrigerant is compressed by a change in a space generated according to an eccentric rotation of the rolling piston. Here, since the eccentric rotation of the rolling piston and compressive force of the refrigerant vary in positions within the cylinder, increasing vibrations.

In order to solve the problem, Korean Patent Laid Open Publication No. 10-2007-0077035 presents a so-called 'twin rotary compressor' having two cylinders. In the twin rotary compressor, two cylinders are disposed up and down and rolling pistons are symmetrically disposed within the two cylinders to reduce vibration. However, since the twin rotary compressor includes two cylinders, the structure is complicated and it is difficult to fabricate them, and an increase in the number of components increases costs.

SUMMARY OF THE INVENTION

An aspect of the present invention provides a rotary compressor which can be fabricated at low cost while minimizing vibration.

According to an aspect of the present invention, there is provided a rotary compressor including: a casing; a cylinder provided within the casing and providing a compression space; a rotational shaft rotatably disposed with respect to the cylinder; a partition plate rotating together with the rotational shaft and dividing the compression space of the cylinder into first and second compression chambers disposed up and down; first and second eccentric portions provided in upper and lower portions of the partition plate and being eccentric in different directions with respect to a rotation center of the rotational shaft so as to rotate together with the rotational shaft; and a driving motor rotatably driving the rotational shaft.

In the aspect of the present invention, the rotary compressor in which an internal space of one cylinder is divided up and down and compression is individually performed in the divided spaces, thereby reducing the number of components relative to the twin rotary compressor, simplifying the structure, and being manufactured at low cost, can be provided. In particular, since the eccentric portions and the partition plate are provided on the rotational shaft, there is no need to separately process and assemble the rotational shaft, the eccentric portions, and the partition plate, and thus, the fabrication process can be simplified. Also, since the two eccentric portions are disposed differently, vibration due to mass non-uniformity and compression force non-uniformity of the eccentric portions can be reduced. For example, when the first and second eccentric portions are symmetrically eccentric with respect to the rotational shaft, i.e., when the first and second eccentric portions are eccentric in the opposite directions with respect to the center of the rotational shaft, vibration of the mass non-uniformity and compression force non-uniformity can be minimized.

Here, the rotational shaft, the eccentric portions, and the partition plate may be integrally formed or may separately formed to be fixed. Also, the partition plate may be rotatably mounted with respect to the rotational shaft or may be fixed to the rotational shaft so as to rotate together with the rotational shaft.

The cylinder and the compression chamber may be formed only with the eccentric portions, and a rolling piston may be additionally provided to an outer circumferential portion of the eccentric portions. In this case, vanes divide the compression chamber into a suction side and a discharge side may be provided in the first and second compression chambers, respectively, and end portions of the vanes may be disposed to be in contact with the eccentric portions or an outer circumferential portion of the rolling piston or may be insertedly fixed to the outer circumferential portion of the rolling piston.

Meanwhile, upper and lower bearings disposed in upper and lower portions of the cylinder to define the compression space are additionally provided, and discharge holes may be formed in the upper and lower bearings and communicate with the first and second compression chambers.

In addition, a suction hole may be additionally formed in the first and second compression chambers in order to supply a fluid as a compression target. The suction hole may be provided in each of the first and second compression chambers, or one suction hole may communicate with the first and second compression chambers. The suction hole may be formed on an outer circumferential portion of the cylinder.

Here, the two vanes may be disposed in an axial direction of the rotational shaft. Thus, the two vanes may be disposed to be close, facilitating assembling.

Meanwhile, the heights of the first and second eccentric portions may be set to be different or equal.

Volume efficiency and mechanical efficiency may vary according to the thickness of the partition plate. The thickness of the partition plate may range from 2.5 mm to 10 mm to improve volume efficiency and mechanical efficiency of the compressor.

A gap between the partition plate and an inner wall of the cylinder may range from 10 μm to 30 μm to reduce frictional loss.

A recess may be formed on an outer circumferential portion of the partition plate to serve as an oil pocket, and thus, frictional loss can be further reduced. Here, an O-ring may be installed in the recess to minimize leakage of a compressed fluid.

According to another aspect of the present invention, there is provided a rotary compressor including: a casing; a cylinder provided within the casing and providing one compression space; two eccentric portions disposed in upper and lower portions of the one compression space; a partition plate disposed such that an outer circumferential portion thereof is in contact with an inner wall of the compression space between the two eccentric portions; and a rotational shaft rotating the eccentric portions, wherein gas compressed by one eccentric portion and gas compressed by another eccentric portion are discharged at different points of time.

According to aspects of the present invention as described above, since the two eccentric portions or rolling pistons are disposed, generation of vibration due to mass non-uniformity and compression force non-uniformity can be minimized, and since the two eccentric portions and the rolling pistons are installed in one cylinder, the structure can be simplified and production cost can be reduced.

In addition, the rotational shaft, the eccentric portions, and the partition plate can be integrally formed and an assembling operation can be simplified. When the partition plate is not rotated upon being in contact with the inner wall of the cylinder and only the rotational shaft rotates, abrasion between the partition plate and the inner wall of the cylinder can be minimized.

In addition, by adjusting the thicknesses of the partition plate and the eccentric portions, volume efficiency and mechanical efficiency can be optimized.

Also, by adjusting the gap between the partition plate and the inner wall of the cylinder, a loss due to friction between the partition plate and the cylinder can be reduced, and by forming a recess on the outer circumferential portion of the partition plate, the frictional loss can be further reduced.

The foregoing and other objects, features, aspects and advantages of the present invention will become more apparent from the following detailed description of the present invention when taken in conjunction with the accompanying drawings.

DETAILED DESCRIPTION OF THE INVENTION

Hereinafter, a rotary compressor according to an embodiment of the present invention will be described in detail with reference to the accompanying drawings.

Figure 1:
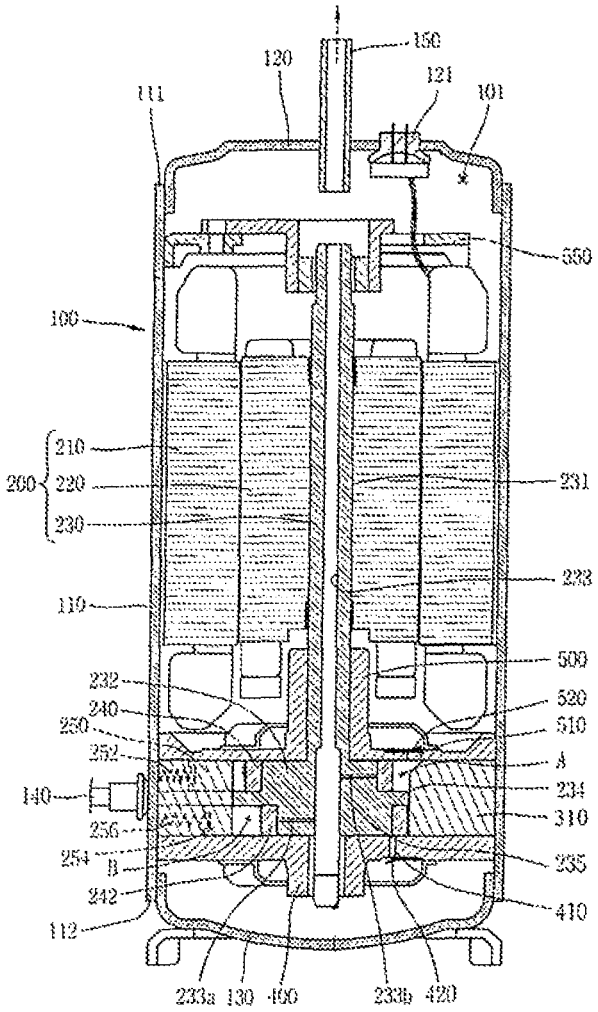
FIG. 1 is a sectional view illustrating a rotary compressor according to an embodiment of the present invention.
Figure 2:
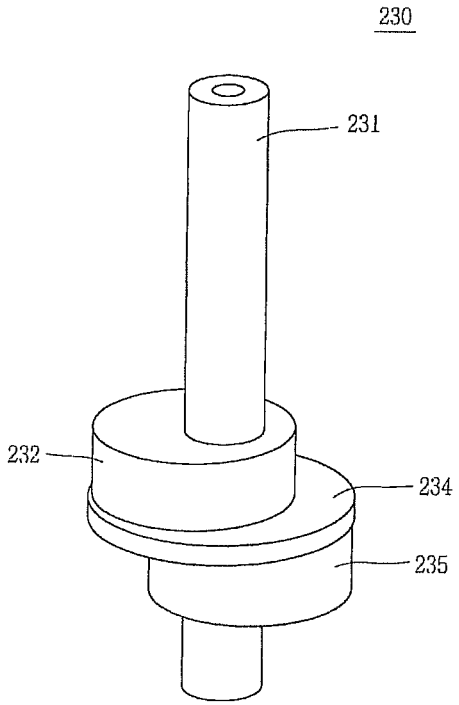
FIG. 2 is a perspective view illustrating a rotational shaft in FIG. 1.
Figure 3:
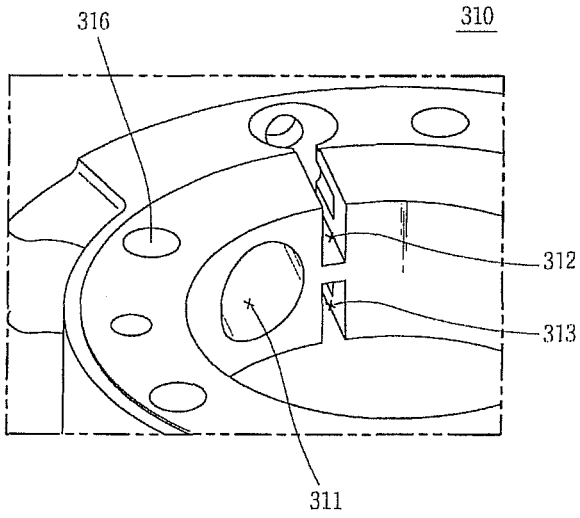
FIG. 3 is a perspective view illustrating a portion of an inner wall surface of a cylinder in FIG. 1.
Figure 4:
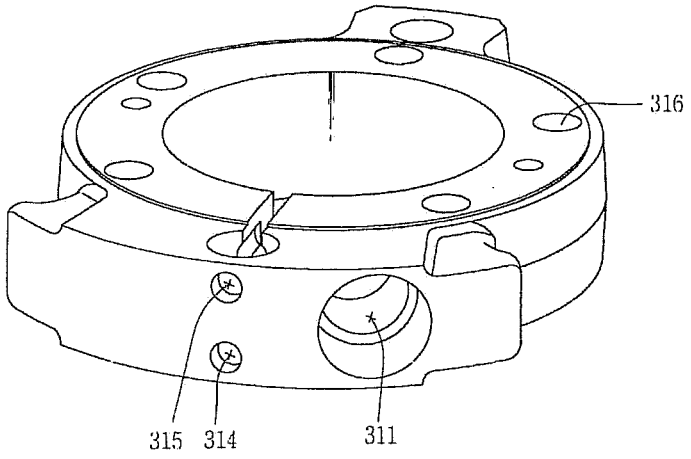
FIG. 4 is a perspective view of the cylinder in FIG. 1.

FIG. 1 is a sectional view illustrating a rotary compressor according to an embodiment of the present invention. FIG. 2 is a perspective view illustrating a rotational shaft in FIG. 1. FIG. 3 is a perspective view illustrating a portion of an inner wall surface of a cylinder in FIG. 1. FIG. 4 is a perspective view of the cylinder in FIG. 1. Referring to FIGS. 1 through 4, in the rotary compressor according to an embodiment of the present invention, a driving motor 200 is installed in an upper portion of an internal space 101 of an airtight container 100. A compression mechanism unit is installed in a lower portion of the internal space 101 to compress a refrigerant by power generated by the driving motor 200. A lower bearing 400 and an upper bearing 500 supporting one end of a crank shaft 230 as a rotational shaft as described hereinafter are installed in a lower side of the driving motor 200. An upper frame 550 is installed in an upper side of the driving motor 200 to support an upper end of the crank shaft 230.

Here, the upper and lower bearings 400 and 500 and the upper frame 550 are fixed by a method such as welding, shrinkage fitting, or the like, to an inner wall of the airtight container 100.

The airtight container 100 includes a container main body 110 in which the driving motor 200 and the compression mechanism are installed, an upper cap (referred to as a 'first cap', hereinafter) 120 covering an upper opening end (referred to as a 'first opening end', hereinafter) 111 of the container main body 110 and a lower cap (referred to as a 'second cap', hereinafter) 130 covering the lower opening end (referred to as a 'second opening end', hereinafter) 112 of the container main body 110.

The container main body 110 has a cylindrical shape, and a suction pipe 140 is coupled in a penetrating manner to a lower circumferential surface of the container main body 110. The suction pipe 140 is directly connected to a suction hole 311 provided on the cylinder 310 as described hereinafter.

The edge of the first cap 120 is bent and welded to the first opening end 111 of the container main body 110. A discharge pipe 150 is coupled in a penetrating manner to the center of the first cap 120 in order to guide a refrigerant discharged to the internal space 101 of the airtight container 100 from the compression mechanism unit, to a refrigerating cycle.

The edge of the second cap 130 is bent and welded to the second opening end 112 of the container main body 110.

The driving motor 200 includes a stator 210 shrinkage-fit to an inner circumferential surface of the airtight container 100 so as to be fixed, a rotor 220 rotatably disposed within the stator 210, and a crank shaft 230 shrinkage-fit to the rotor 220 and rotating together therewith to transmit rotatory power of the driving motor 200 to the compression mechanism unit.

The stator 210 is formed by laminating a plurality of stator sheets by a predetermined height, and a coil is wound around teeth provided on an inner circumferential surface thereof.

The rotor 220 is disposed on the inner circumferential surface of the stator 210 with a certain air gap therebetween, and the crank shaft 230 is press-fit through shrinkage-fitting to the center of the rotor 220 so as to be integrally coupled.

Referring to FIG. 2, the crank shaft 230 includes a shaft portion 231 coupled to the rotor 220, first and second eccentric portions 232 and 235 eccentrically formed on a lower end portion of the shaft portion 231, and a partition plate 234 positioned between the first and second eccentric portions 232 and 235. Here, the partition plate 234 between the first and second eccentric portions 232 and 235 is integrally formed with the crank shaft 230, but the present invention is not necessarily limited thereto. For example, an example in which only the shaft portion 231 of the crank shaft 230 is first processed, and thereafter, the first and second eccentric portions 232 and 235 and the partition plate 234 are fixed through a fixing unit may also be considered.

Here, the first and second eccentric portions 232 and 235 are disposed symmetrically with respect to the rotation center of the crank shaft 230.

An oil flow channel 233 is formed in a penetrating manner in the axial direction within the crank shaft 230 to allow oil of the airtight container 100 to be sucked up. Here, the oil flow channel 233 includes two oil supply paths 233*a* and 233*b* extending in a radial direction within the first and second eccentric portions 232 and 235. The oil supply paths 233*a* and 233*b* supply a portion of oil supplied through the oil flow channel 233 to an outer side of the first and second eccentric portions 232 and 235 to allow a rolling piston (to be described) to be smoothly rotated.

Meanwhile, the compression mechanism unit includes the cylinder 310 installed within the airtight container 100, and first and second rolling pistons 240 and 242 rotatably coupled to the first and second eccentric portions 232 and 235 of the crank shaft 230 and rotating in a compression space of the cylinder 310 to compress a refrigerant. The first and second rolling pistons 240 and 242 have an inner diameter slightly greater than an outer diameter of the eccentric portions 232 and 235, so the first and second rolling pistons 240 and 242 may freely rotate about the eccentric portions 232 and 235 by being centered thereon.

Thus, when the crank shaft 230 rotates in the compression space formed within the cylinder 310, the first and second rolling pistons 240 and 242 inserted into the outer circumferential surfaces of the first and second eccentric portions 232 and 235 rotate in a state of being in contact with the inner wall of the compression space of the cylinder 310.

Meanwhile, the partition plate 234 has an outer diameter slightly smaller than the inner diameter of the cylinder 310 and rotates together with the crank shaft within the compression space of the cylinder 310. Also, the partition plate 234 divides the compression space up and down to form first and second compression chambers A and B. The first and second rolling pistons 240 and 242 rotate within the first and second compression chambers, and thus, the refrigerant is sucked and compressed in the two compression chambers.

Two vanes 250 and 254 are provided in the first and second compression chambers to partition the first and second compression chambers into a suction space and a discharge space. In addition, coil springs 252 and 256 for pushing the vanes toward the rolling pistons 240 and 242 are installed on the inner wall of the cylinder 310. FIGS. 3 and 4 illustrate the cylinder 310 in detail. Two vane slots 312 and 313 are formed in parallel in one side of the inner wall of the cylinder. The vane slots 312 and 313 serve to prevent the vanes 250 and 254 from being released and guide a sliding movement of the vanes 250 and 254.

Two spring insertion holes 314 and 315 are formed in an outer side of the two vane slots 312 and 313, through which the coil springs 252 and 256 for pushing the vanes 250 and 254 are inserted. One suction hole 311 is formed to be adjacent to the spring insertion holes 314 and 315. The suction hole 311 is formed to have a diameter communicating with the first and second compression chambers A and B based on the partition plate 234 as a boundary. The suction hole 311 is connected to the suction pipe 140 to allow the refrigerant introduced through the suction pipe 140 to be introduced to the first and second compression chambers A and B.

Also, a plurality of oil through holes 316 is formed in the axial direction of the crank shaft 230 in the cylinder 310 to allow oil to be supplied therethrough to the upper bearing 500 and the lower bearing 400.

The foregoing upper bearing 500 and the lower bearing 400 are installed in upper and lower portions of the cylinder 310. The upper and lower bearings 500 and 400 hermetically close upper and lower portions of the space provided within the cylinder 310 to provide a compression space. In addition, the upper and lower bearings 500 and 400 are in contact with the first and second eccentric portions 232 and 235 and the first and second rolling pistons 240 and 242 to play a lubricating function to allow the first and second eccentric portions 232 and 235 and the first and second rolling pistons 240 and 242 to be smoothly rotated.

First and second discharge holes 510 and 410 are formed in the upper and lower bearings 500 and 400, and discharge valves 520 and 420 having a leaf spring form are installed in the respective discharge holes. Accordingly, the refrigerant sucked and compressed in the first and second compression chambers A and B are discharged to the internal space of the airtight container 100.

The operation of the rotary compressor will be described.

When power is applied through a terminal provided in the airtight container 100, the driving motor 200 operates and the crank shaft 230 rotates. Here, a negative pressure is applied to the compression chamber in a suction stroke (or an intake stroke) among the two compression chambers, and a refrigerant is introduced through the suction pipe 140 and the suction hole 311. The introduced refrigerant is compressed and discharged as the eccentric portions 232 and 235 and the rolling pistons 240 and 242 rotate.

Here, since the first and second eccentric portions 232 and 235 are disposed to be symmetrical with the center of the crank shaft 230, the refrigerant in the first and second compression chambers A and B are under different operations. For example, in FIG. 1, the refrigerant in the first compression chamber A is in a state of starting to be sucked after having been completely discharged, and the refrigerant in the second compression chamber is in a state of being compressed after having been completely sucked.

Here, since the first and second eccentric portions 232 and 235 are symmetrically disposed, masses of the respective eccentric portions 232 and 235 are balanced with respect to the rotation center of the crank shaft 230. Also, since pressures according to the refrigerant compression act in a symmetrical direction on the first and second compression chambers A and B, pressure imbalance may be canceled out to a degree. Thus, vibrations caused during the operation are minimized.

The embodiment may be variously modified. In the illustrated example, the rolling pistons are additionally provided on the outer circumferential portions of the eccentric portions, but the present invention is not necessarily limited thereto and only the eccentric portions may be provided without a rolling piston. In this case, an end portion of the vane may be maintained in a state of being in contact with the surface of the eccentric portions.

Also, the thickness of the partition plate 234 and the thickness of the first and second eccentric portions 232 and 235 may be changed. By regulating the numerical values, volume efficiency or mechanical efficiency can be improved. Namely, since the partition plate 234 rotates together with the rotational shaft, it is continuously in a frictional contact with the inner wall of the cylinder. In addition, as the partition plate 234 becomes thicker, a volume of a valid space of the inner space of the cylinder is increased, but when the partition plate 234 becomes thinner, strength is reduced.

Also, when the thicknesses of the eccentric portions 232 and 235 are increased, the valid volume may be increased but a vertical directional movement of the refrigerant within the compression chamber is also increased to degrade compression efficiency. Also, theoretically, when the thicknesses of the two eccentric portions 232 and 235 are equal, vibration due to the mass imbalance and pressure non-uniformity may be minimized, but it may not necessarily be according to a type, a size, or the like, of a compressor.

In this case, however, in the present embodiment, since the crank shaft 230 and the two eccentric portions 232 and 235 are disposed within one cylinder, although the thicknesses of the eccentric portions 232 and 235 and the partition plate 234 are different, the cylinder 310 and the upper and lower bearings 500 and 400 are shared as is, development cost can be reduced.

Figure 5:
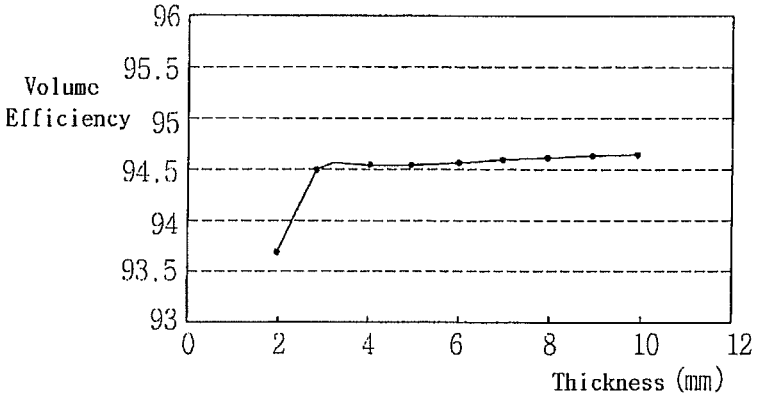
FIG. 5 is a graph showing a change in volume efficiency over a difference in thickness of a partition plate in the rotary compressor illustrated in FIG. 1.
Figure 6:
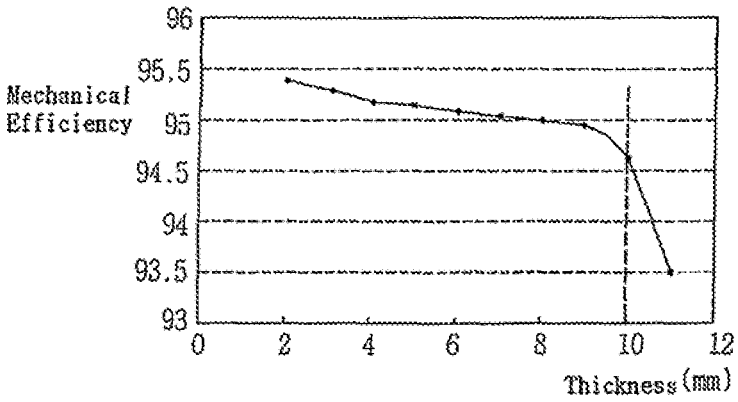
FIG. 6 is a graph showing a change in mechanical efficiency over a difference in thickness of the partition plate in the rotary compressor illustrated in FIG. 1.

FIGS. 5 and 6 are graphs showing a change in volume efficiency and mechanical efficiency according to thickness of the partition plate. As illustrated, in the case of the volume efficiency, it can be seen that although the thickness of the partition plate is increased, there is no change in the volume efficiency starting from 2.5 mm In the case of mechanical efficiency, it can be seen that mechanical efficiency is lowered as the thickness of the partition plate is increased, and mechanical efficiency is sharply degraded starting from 10 mm.

Thus, the thickness of the partition plate 234 is set to range from 2.5 mm to 10 mm.

Frictional force between the partition plate and the inner wall of the cylinder, frictional force between the upper bearing and the eccentric portion or the rolling piston, and frictional force between the lower bearing and the eccentric portion or the rolling piston affect mechanical efficiency of the rotary compressor according to an embodiment of the present invention. Namely, since the partition plate is not integrally formed with the crank shaft, the partition plate rotates with respect to the inner wall of the cylinder, causing frictional force. In addition, shear frictional force acts between the upper and lower bearings and the eccentric portions and the rolling pistons. In order to minimize such frictional force, oil should be sufficiently provided and a gap therebetween should be appropriately set.

If the gap is excessively small, oil cannot be sufficiently supplied and two frictional surfaces come into direct contact by external force such as vibration, increasing frictional force. Meanwhile, when the gap is set to be excessively large, frictional force may be reduced but a compressed refrigerant is leaked to degrade a discharge pressure. Thus, in the rotary compressor according to an embodiment of the present invention, a gap between two frictional surfaces is set to range from 10 μm to 30 μm.

Figure 7:
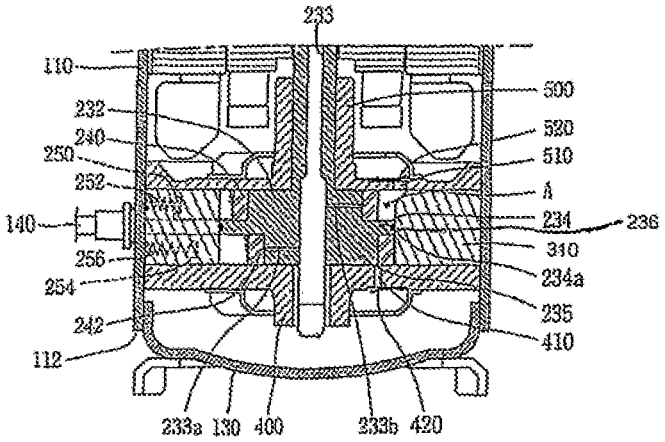
FIG. 7 is a sectional view illustrating a modification of the partition plate in the rotary compressor illustrated in FIG. 1.

In addition, as illustrated in FIG. 7, a recess 234*a* may be formed on an outer circumferential surface of the partition plate, and an O-ring 236 may be may be installed in the recess 234*a* to minimize leakage of the compressed refrigerant. The recess 234*a* reduces a contact area between the partition plate and the inner wall of the cylinder to reduce frictional force, and may serve as an oil pocket in which supplied oil is collected, so as to be advantageous for reducing frictional force. Here, the recess 234*a* is not necessarily formed on the partition plate and may be formed on the inner wall of the cylinder facing the partition plate.

As described above, the rotary compressor according to embodiments of the present invention has the same level of vibration preventing performance as that of the related art twin rotary compressor and incurs relatively low production cost. The results of measurement show that when the production cost of the related art single cylinder rotary compressor is assumed to be 100, the twin rotary compressor is fabricated at 130, and the rotary compressor according to an embodiment of the present invention can be fabricated at 115.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A rotary compressor, comprising:

a casing;

a cylinder provided within the casing and providing one compression space;

two eccentric portions disposed in upper and lower portions of the one compression space;

a partition plate that protrudes from between the two eccentric portions and is disposed such that an outer circumferential portion thereof is in contact with an inner wall of the compression space; and a rotational shaft that rotates the two eccentric portions, wherein gas compressed by one of the two eccentric portions and gas compressed by the other of the two eccentric portions are discharged at different points of time.

2. The rotary compressor of claim 1, wherein the partition plate is integrally formed with the rotational shaft.

3. The rotary compressor of claim 1, wherein the two eccentric portions are disposed to be symmetrical with respect to a center of the rotational shaft.

4. The rotary compressor of claim 1, wherein an annular rolling piston is inserted into outer circumferential portions of the two eccentric portions, respectively.

5. A rotary, compressor, comprising:

a casing;

a cylinder disposed within the casing and providing a compression space;

a rotational shaft rotatably disposed with respect to the cylinder;

a partition plate that rotates together with the rotational shaft and divides the compression space of the cylinder into a first compression chamber and a second compression chambers disposed at upper and lower portion of the partition plate;

a first eccentric portion and a second eccentric portions provided in the upper and lower portions of the partition plate, respectively, and being eccentric in different directions with respect to a rotational center of the rotational shaft so as to rotate together with the rotational shaft;

a drive motor that rotatably drives the rotational shaft, a suction hole provided on an outer circumferential portion of the cylinder;

wherein the suction hole communicates with both the first compression chamber and the second compression chamber.

6. The rotary compressor of claim 5, wherein the first and second eccentric portions are eccentric in opposite directions with respect to the center of the rotational shaft.

7. The rotary compressor of claim 5, further comprising:

two vanes disposed in the first and second compression chambers, respectively, to divide the same.

8. The rotary compressor of claim 7, wherein the vanes are disposed such that end portions of outer circumferential portions thereof are in contact with outer circumferential portions of the first and second eccentric portions, respectively.

9. The rotary compressor of claim 7, further comprising:

first and second rolling pistons provided in outer circumferential portions of the first and second eccentric portions, respectively.

10. The rotary compressor of claim 9, wherein the vanes are disposed such that end portions thereof are in contact with outer circumferential portions of the first and second rolling pistons, respectively.

11. The rotary compressor of claim 9, wherein end portions of the vanes are inserted into outer circumferential portions of the first and second rolling pistons, respectively.

12. The rotary compressor according to claim 7, wherein two vane slots are formed in one side of an inner wall of the cylinder, and wherein the two vanes are inserted into the respective vane slots.

13. The rotary compressor of claim 5, further comprising:

upper and lower beatings disposed in upper and lower portions of the cylinder to define the compression space; and discharge holes formed in the upper and lower bearings, that communicate with the first and second compression chambers, respectively.

14. The rotary compressor of claim 13, wherein a gap between the upper and lower bearings and the respective eccentric portions ranges from 10 μm to 30 μm.

15. The rotary compressor of claim 5, wherein heights of the first and second eccentric portions are equal.

16. The rotary compressor of claim 5, wherein a thickness of the partition plate ranges from 2.5 mm to 10 mm.

17. The rotary compressor of claim 5, wherein a gap between the partition plate and an inner wall of the cylinder ranges from 10 μm to 30 μm.

18. The rotary compressor of claim 5, wherein a recess is formed on an outer circumferential portion of the partition plate.

19. The rotary compressor of claim 18, wherein an O-ring is installed in the recess.

* * * * *